US005417457A

United States Patent [19]

Reinhardt

[11] Patent Number: 5,417,457

[45] Date of Patent: May 23, 1995

[54] INDEXING/ORGANIZATION SYSTEM

[76] Inventor: William S. Reinhardt, 485 Old Mill Rd., Barrington, Ill. 60010

[21] Appl. No.: 144,641

[22] Filed: Oct. 28, 1993

[51] Int. Cl.[6] ..... B42D 3/00

[52] U.S. Cl. ..... 283/36; 283/81; 283/117; 281/51

[58] Field of Search ..... 283/36, 81, 74, 79, 283/117, 55; 281/51, 43; 40/312

[56] References Cited

U.S. PATENT DOCUMENTS

| | | | |
|---|---|---|---|
| 4,637,149 | 1/1987 | Rivkin . | |
| 4,679,823 | 7/1987 | Nagy | 281/43 |
| 4,832,374 | 5/1989 | Prest, Jr. . | |
| 4,899,879 | 2/1990 | Rosen . | |
| 4,972,615 | 11/1990 | Grant . | |
| 5,123,676 | 6/1992 | Donnelly et al. . | |
| 5,197,761 | 3/1993 | Shirdavani | 281/51 X |
| 5,197,764 | 3/1993 | Hicinbothem et al. . | |
| 5,249,827 | 10/1993 | Olson | 283/36 |

*Primary Examiner*—Willmon Fridie
*Attorney, Agent, or Firm*—Charles F. Meroni, Jr.

[57] ABSTRACT

The present invention relates to an indexing and organizing system for audio/video tapes and compact/video discs. The system providing self adhesive labels and flags comprising sheets of thin semi-rigid flexible material. Each label having an adhesive applied to a back portion thereof. Each label has three panels to embrace a front portion, side portion and back portion of a storage case for a video/audio tape or video/compact disc whereby when a self adhesive label is attached to a storage case, the label can be seen on three sides of the storage case identifying the alphabetic location and/or category of the media stored in the storage case. Each flag has a rectangular main body and has a protruding label portion. The flag has an adhesive applied to a back side of the rectangular main body thereof leaving the protruding label portion adhesive free. The flag is long enough to embrace a side portion of a storage case for a video/audio tape or video/compact disc whereby when the self adhesive flag is attached to a storage case, the protruding label portion can be seen from two sides of said storage case.

21 Claims, 7 Drawing Sheets

INDEXING/ORGANIZATION SYSTEM

BACKGROUND OF THE INVENTION

The present invention relates to an indexing/organization system for storage cases. This invention is specifically targeted at movie and music industry products including audio/video tapes and compact/video discs. Other applications of this system, with slight modifications, would be books and home filing systems.

This product is a comprehensive indexing/organization system to allow individuals quick and easy selection of a specific cassette or disc from their personal collection. Most individuals devise their own system and most often cannot identify or locate the video/audio tape or video/compact disc they desire due to the small print on the exposed edge of the storage case and the poor lighting available where discs are stored. The present system of using labels and flags allows the individual to label and file their discs in a variety of methods and the individual will be able to easily file and retrieve their discs without confusion and disorganization.

No other systems have been invented or made available to the public to help an individual easily organize and find the desired disc or cassette from within a large personal collection. All storage systems of this type are absent identifying dividers, separations and therefore, lend themselves to disorganization and confusion. Many types of organization systems are readily available for paper files and the like, however, an organization system for audio/video tapes and video/compact discs is not available. This invention provides removable, self-adhesive labels and flags for easily organizing and indexing any type of audio/video media and provides years of dedicated service to the individual using the system. The system is flexible, changeable, and fits the unique and unsatisfied needs of the audio and video disc/tape collector.

SUMMARY OF THE INVENTION

In view of the lack of personal indexing and organizing systems for audio/video tapes and compact/video discs, it is a general object of the present invention to provide a storage system for audio and video cassettes and disks including individualized disk containers each of a uniform shape and size, and held in a case in side by side relation, the improvement comprising an indexing system for the disk containers, the system including self adhesive labels and self adhesive flags, each of the self adhesive labels comprising a sheet of thin semi-rigid flexible material. Each label having an adhesive applied to a back portion thereof. Each label has three panels to embrace a front portion, side portion and back portion of a storage case for a video/audio tape or video/compact disc whereby when the self adhesive label is attached to a storage case, each label can be seen on three sides of the storage case.

Other features of my invention provide that each self adhesive label is made of a one piece plastic laminate.

Further features of my invention provide that each panel on a self adhesive label includes an alphabetic character or a category printed on each panel in order to alphabetize and/or organize audio/video tapes and video/compact discs.

Still other features of my storage system provide a self adhesive flag comprising a sheet of thin semi-rigid flexible material. The flag having a rectangular main body and having a protruding label portion, the flag having an adhesive applied to a back side of the rectangular main body thereof leaving the protruding label portion adhesive free. The flag being long enough to embrace a side portion of a storage case for a video/audio tape or video/compact disc whereby when the self adhesive flag is attached to a storage case, the protruding label portion can be seen from two sides of said storage case.

Yet other features of my invention provide that the protruding label portion includes an alphabetic character printed on each side.

Even further Features of my invention provide the combination self adhesive labels and self adhesive flags, wherein the self adhesive labels and flags can be used in conjunction to index and organize audio/video tapes and video/compact discs.

This system provides an organized method to store and subsequently retrieve specific audio/video tapes and compact/video discs. This system provides the user with semi-rigid, yet flexible laminated plastic category labels and alphabetic labels to attach to storage cases. These labels provide for both category and alphabetic divisions. The labels are useful and effective in virtually any position and especially in the vertical and horizontal positions depending on the individual's method of storing the media.

DESCRIPTION OF THE PREFERRED EMBODIMENT

Figure 2:
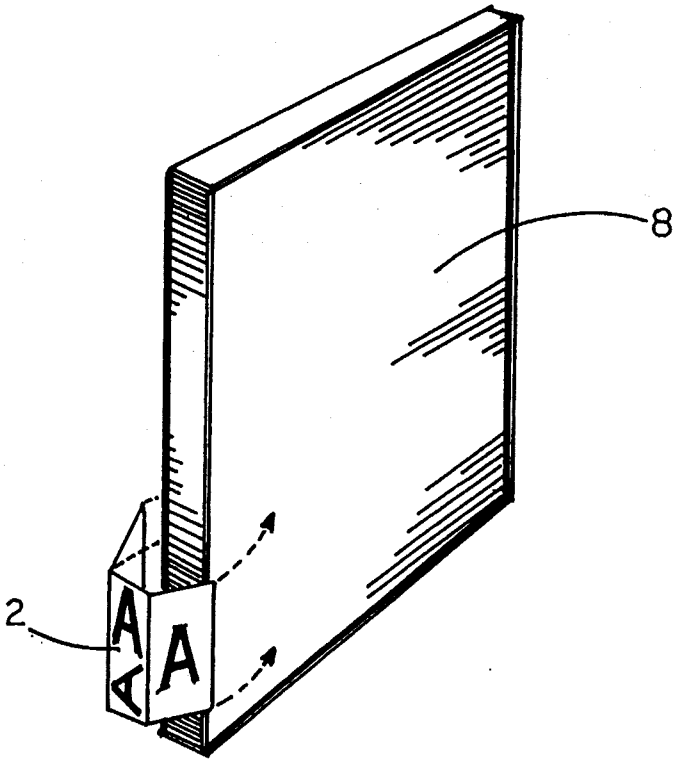
FIG. 2 is a perspective view showing how the alphabetic label is attached to the storage case.
Figure 1:
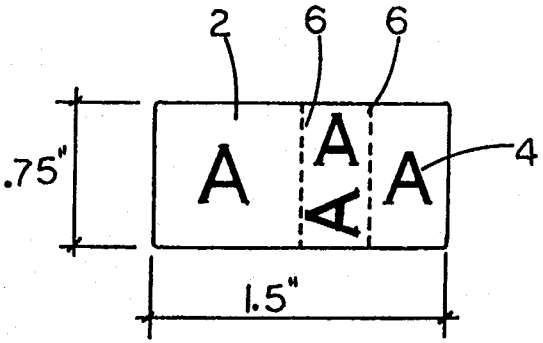
FIG. 1 is a top plan view showing an alphabetic label for placement onto a storage case embodying important features of my invention.

Referring now to the drawings, FIG. 1 illustrates an example of a three paneled alphabetic label 2 made of a semi-rigid, flexible plastic laminate having an alphabetic character 4 for marking the outermost edge of a storage case. An adhesive will be on the back side of the label 2 to adhere the label to the storage case, but also providing for the label to be removable. FIG. 1 also shows dimensions of the label 2 acceptable for placement onto a storage case for compact discs. Fold lines 6 indicate the area where the alphabetic label 2 is folded over the edges of the storage case. FIG. 2 shows how the alphabetic label 2 is applied to a storage case 8 of a compact disc.

Figure 4:
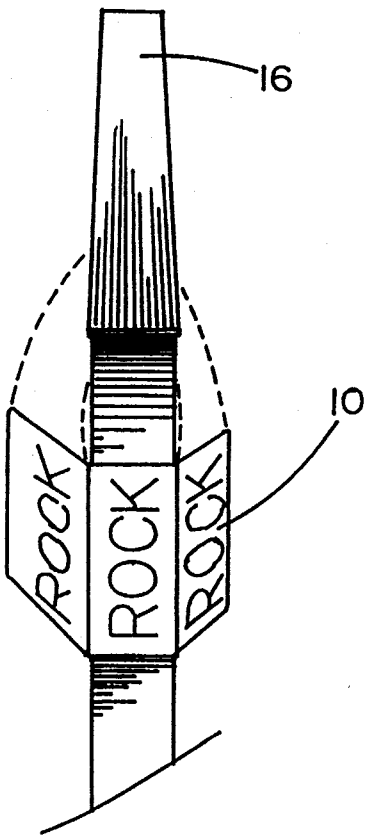
FIG. 4 is a partial side view showing how the category label is attached to the storage case embodying further features of my invention.
Figure 3:
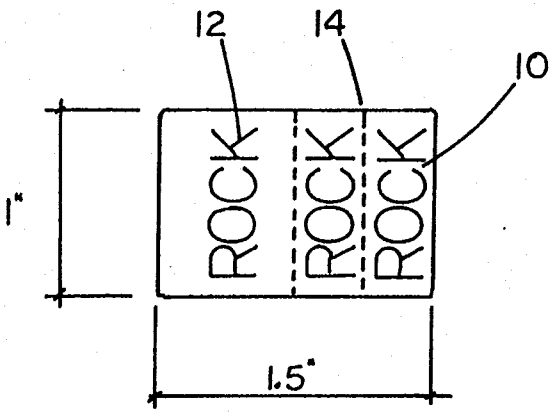
FIG. 3 is top plan view showing a category label for placement onto a storage case.

The drawing identified as FIG. 3 displays a three-paneled category label 10 made of a semi-rigid, flexible plastic laminate for application to the top or bottom of a storage case to identify a category 12. An adhesive will be on the back side of the category label 10 to adhere the label to the storage case, but also providing for the category label to be removable. Acceptable dimensions are included for placement onto a storage case for a compact disc. Fold lines 14 indicate the area where the category label 10 is folded over the edges of the storage case. FIG. 4 shows how the category label 10 is attached to a storage case 16.

The alphabetic and category labels 2, 10 are approximately 1½ inches in length and between ⅝–1 inch in width. The labels 2, 10 are best positioned 1/32 inch above or below the edge of a compact disc or cassette case, therefore, leaving room to read the title on the edge of the case. These labels give a clear, visual identification from three sides and make it easy for the user to select different types of music in the appropriate alphabetic arrangement.

Figure 6:
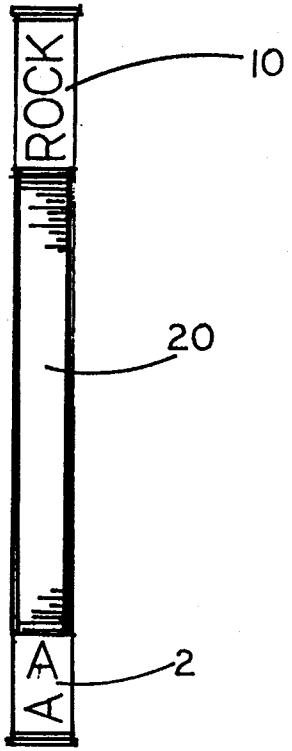
FIG. 6 is a side view of the alphabetic label and category label attached to the storage case.
Figure 5:
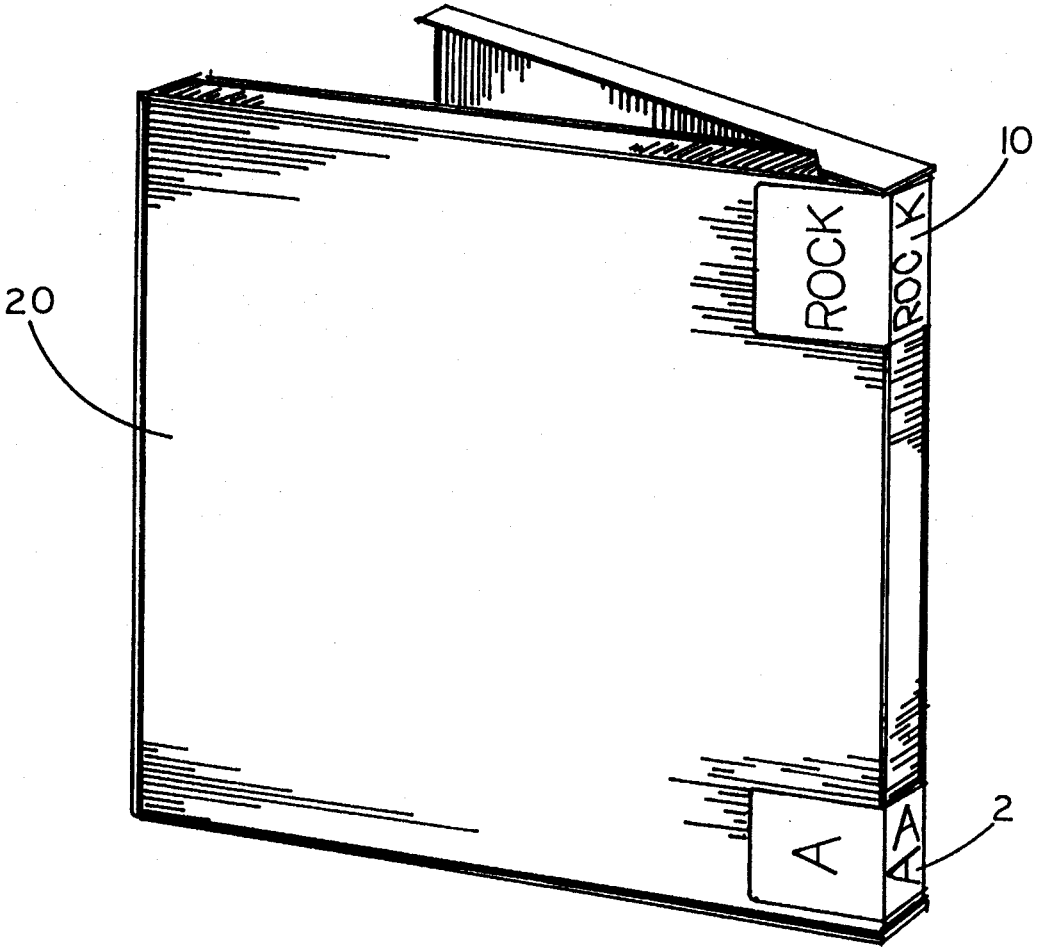
FIG. 5 is a perspective view of the alphabetic label and category label attached to the storage case.

FIGS. 5 and 6 show where the alphabetic label 2 and the category label 10 could be placed on a storage case 20.

Figure 7:
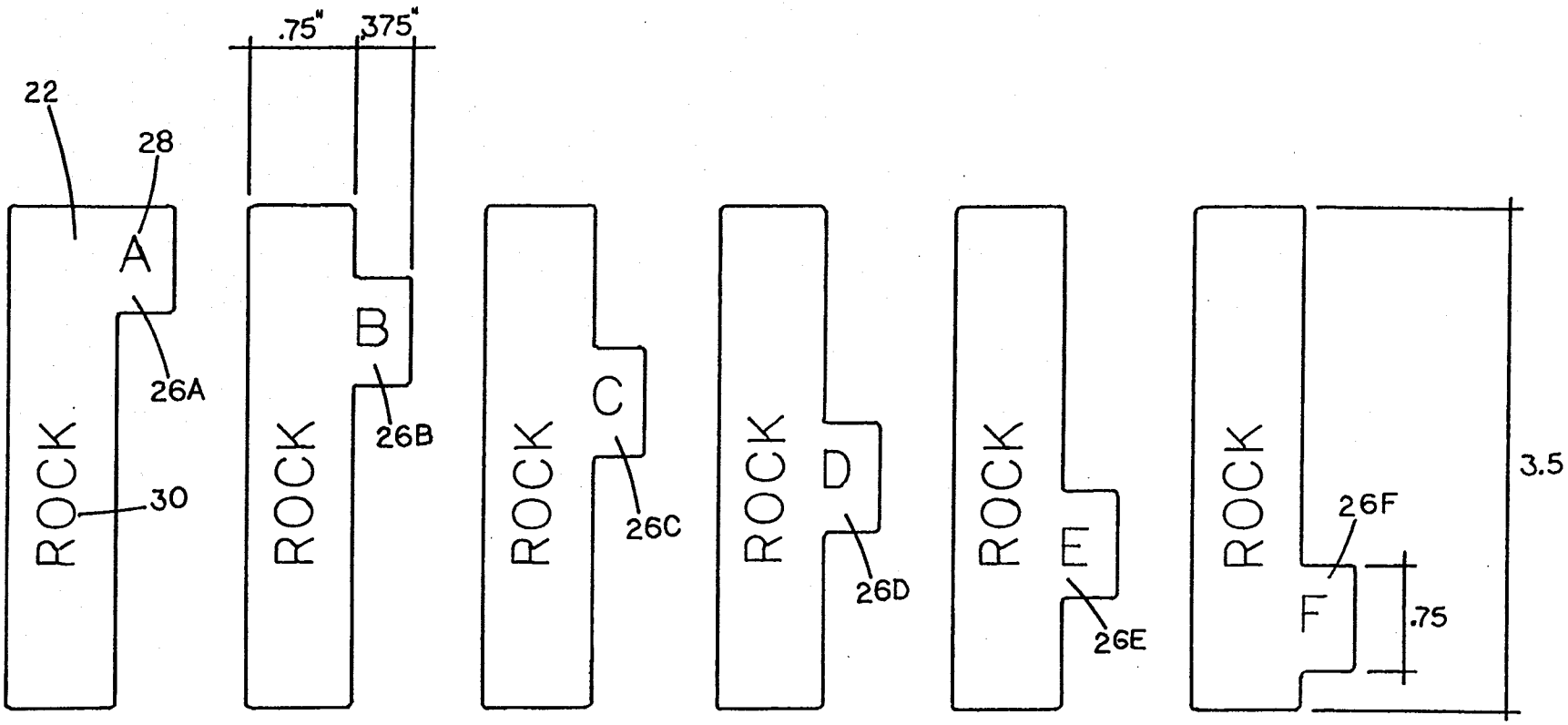
FIG. 7 is a top plan view of my flags for placement onto a storage case to index and organize storage cases by category and/or alphabetically.

FIG. 7 shows a flag 22 made of a semi-rigid, flexible plastic laminate. The flag 22 having a rectangular main body 24 and a protruding flag 26A. An adhesive strip is located on the back side of the rectangular main body 24 for placement onto a storage case, but also providing the flag 22 to be removable. The protruding flag 26A has an alphabetic character 28A printed on both sides thereof. The rectangular main body 24 has a category 30 printed on the front side thereof. The rectangular main body 24 is approximately 3⅜–3½ inches in length. The rectangular main body 24 is the foundation for support for the protruding flag 26A. The protruding flag 26A is a part of the rectangular main body 24 and is ¾ inch high and protrudes ⅜ inch. The protruding flag 26A–26F is arranged in six different positions along the rectangular main body 24 to allow quick visual access of six ascending alphabetic characters. Each protruding flag 26B–26F overlaps the previous one by approximately ¼ inch without hiding the view of the alphabetic characters. The protruding flags 26A–26F also allow the user to grab the protruding flag and pull it towards him or her for easy removal from a large grouping.

Figure 10:
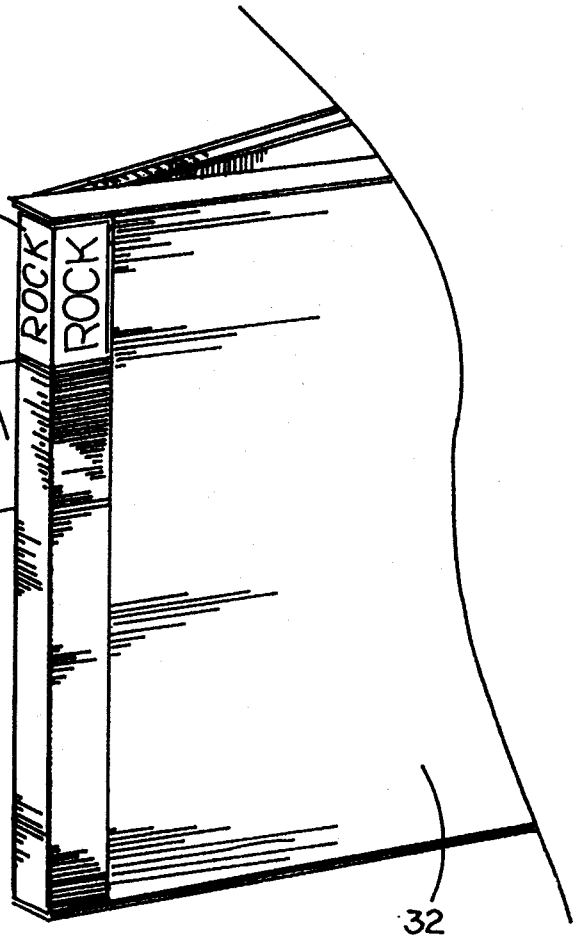
FIG. 10 is a partial back perspective view illustrating how category labels and flags could be used on a storage case.
Figure 9:
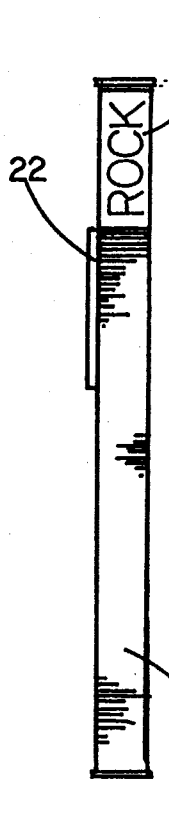
FIG. 9 is a side view illustrating how category labels and flags could be used on a storage case.
Figure 8:
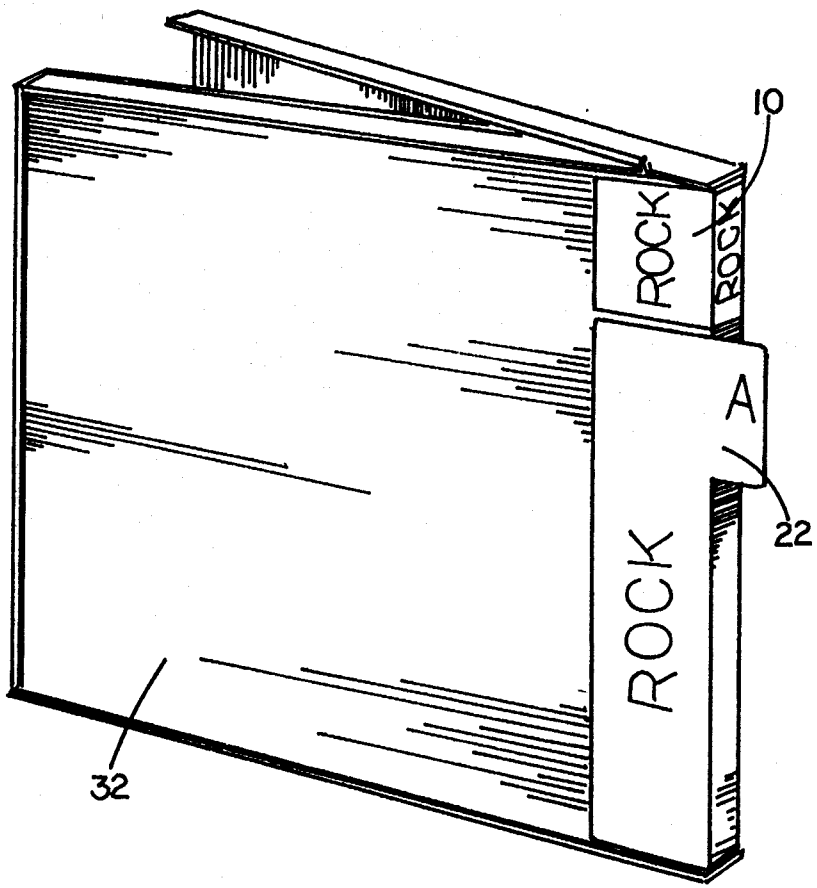
FIG. 8 is a front perspective view illustrating how category labels and flags could be used on a storage case.
Figure 11:
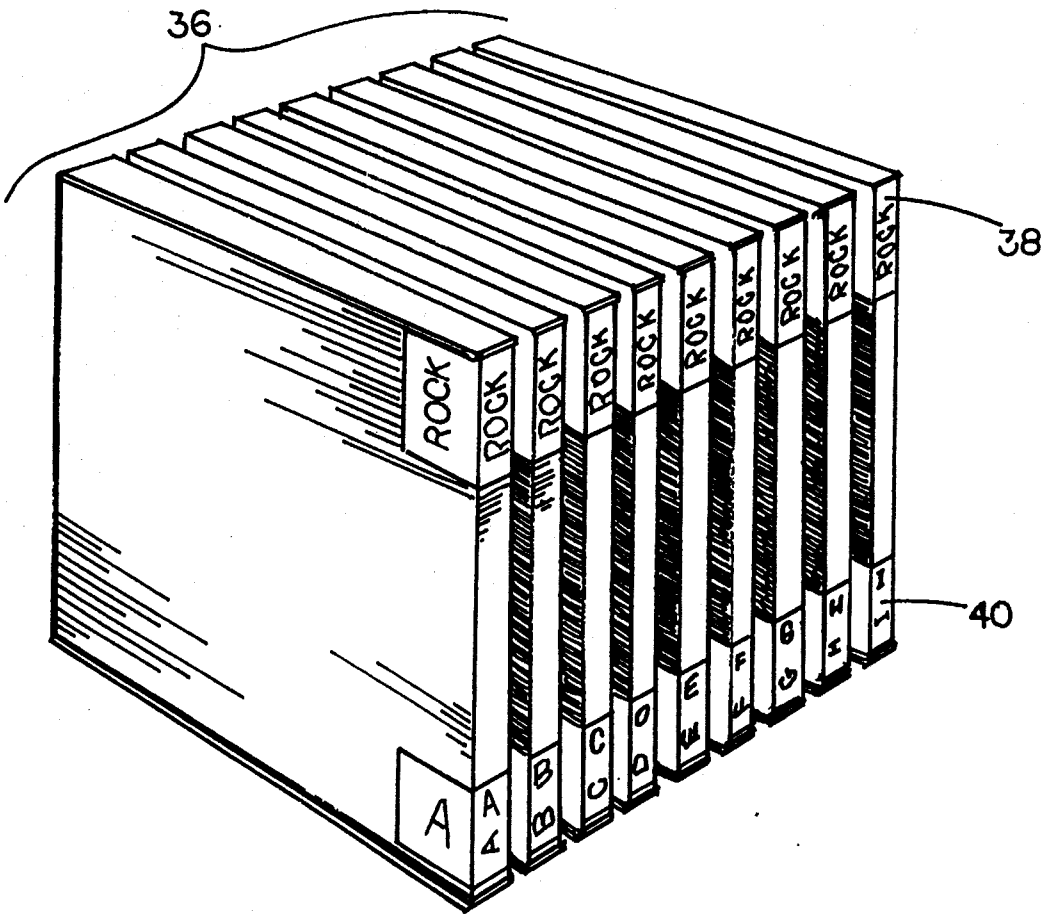
FIG. 11 is a perspective view illustrating my index/organization system using alphabetic labels and category labels as could be applied to a set of storage cases.
Figure 12:
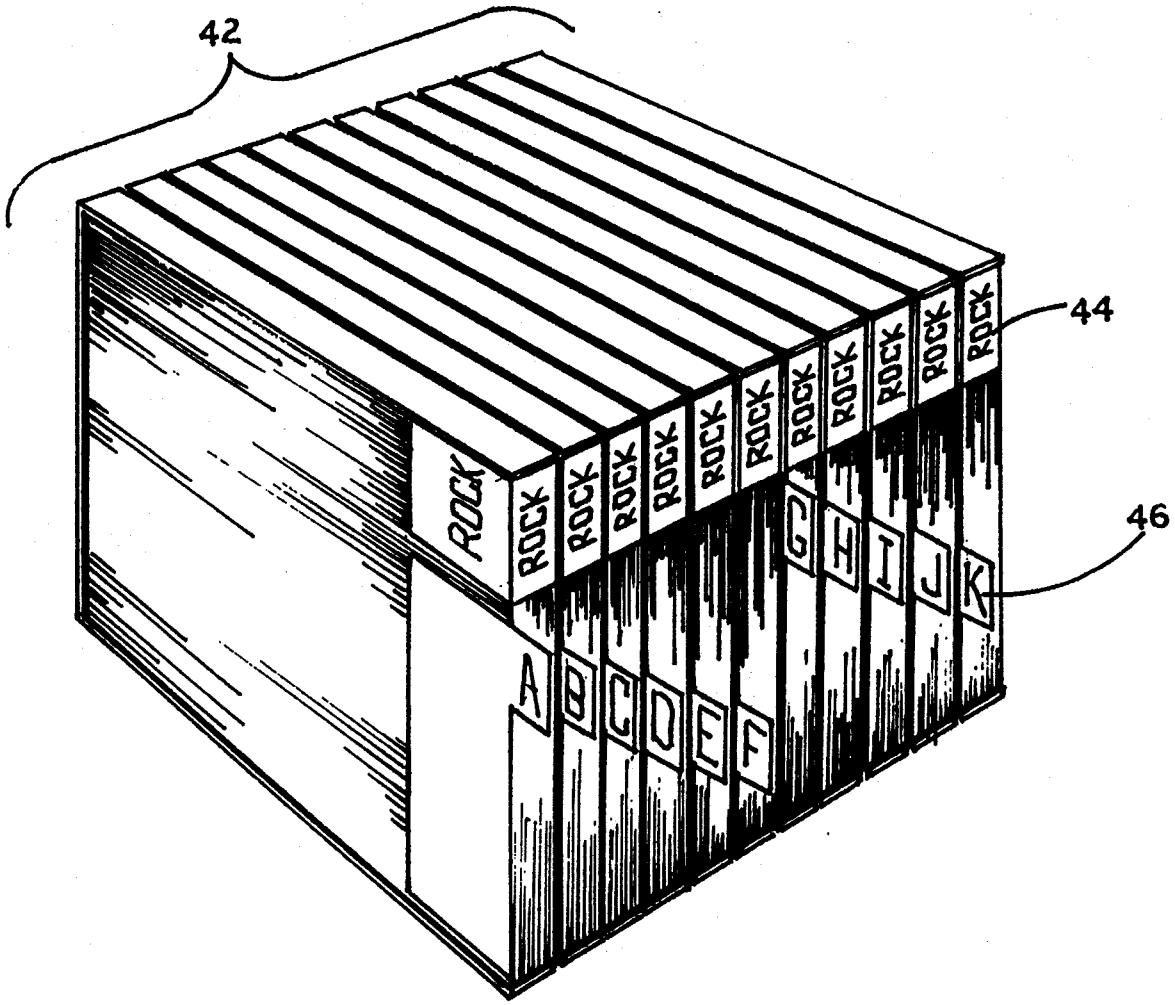
FIG. 12 is a perspective view illustrating my index/organization system using category tabs and flags as could be applied to a set of storage cases.

FIGS. 8–10 show how the combination of category labels 10 and flags 22 can be used on a storage case. FIG. 11 shows how a set of storage cases 36 containing audio/video tapes or video/compact discs could be indexed and organized using the combination of category labels 38 and alphabetic labels 40. FIG. 12 shows how a set of storage cases 42 could be indexed and organized using the combination of category labels 44 and flags 46.

The labels and flags could be position on the top, side or bottom of the case to allow easy use of any existing storage devices. The system provides a plastic laminate label to be attached (removable later) to one case to signify a category and a label to indicate a section of the alphabet within the collection. Most individuals have reasonably large collections of discs and require both an alphabetic and category division. Additional organization of the collections can be done having different colored labels and flags. This system allows the individual to customize their system to fit specific requirements they wish to apply.

Excellent results are achieved by using a paper stock (80# coated 2 sides litho cover stock) coated two sides for the labels and flags. The sheets can be printed with the appropriate characters using black inkthen the sheets will be (heat activated) laminated on both sides. The top side of the sheets is a Co poly Polyester 1.7 mil clear plastic gloss laminate (available at GBC, 712 W. Winthrop, Addison, Ill. 60101; 1.7 Mil Nap lam II film) and the bottom side is a Co poly Polyester 1.7 mil glue/-stamp treated clear plastic gloss laminate. A pressure sensitive adhesive (acrylic, available at Davidson Metals, 1615 Wilson Ave., Youngstown, Ohio, 44506) is then applied to the bottom side of the laminated sheets. Excellent results are achieved using an acrylic based glue that will be either 2 or 3 mil in thickness with a silicon release liner. All the laminated adhesive sheets are then die cut to final shapes and sizes.

As various possible embodiments may be made in the above invention for use for different purposes and as various changes might be made in the embodiments and method above set fort, it is understood that all of the above matters here set forth or shown in the accompanying drawings are to be interpreted as illustrative and not in a limiting sense.

I claim:

1. A storage system for audio and video cassettes and disks including individualized disk containers each of a uniform shape and size, and held in a case in side by side relation, the improvement comprising an indexing system for the disk containers, the system including self adhesive labels and self adhesive flags, each of the self adhesive labels comprising a sheet of thin semi-rigid flexible material, each of said labels having an adhesive applied to a back portion thereof, each of said labels having three panels, said panels being long enough to embrace a from portion, side portion and back portion of a storage case for a video/audio tape or video/compact disc, each of the self adhesive flags comprising a sheet of thin semi-rigid flexible material, each of said flags having a rectangular main body and having a protruding label portion, each of said flags having an adhesive applied to a back side of the rectangular main body thereof leaving the protruding label portion adhesive free, each of said flags being long enough to embrace a side portion of a storage case for a video/audio tape or video/compact disc whereby the self adhesive labels and self adhesive flags can be attached to a number of storage cases to index and organize said storage cases.

2. The storage system of claim 1 wherein each of said sheets of thin semi-rigid flexible material comprise a one piece plastic laminate.

3. The storage system of claim 1 wherein said labels are printed with an alphabetic character on each of the three panels.

4. The storage system of claim 1 wherein the labels have a printed indicia, the indicia including various terminology identifying different musical styles.

5. The storage system of claim 1 wherein said flags have an alphabetic character printed on both sides of the protruding portion.

6. The storage system of claim 1 wherein said flags have a printed indicia printed on the non-adhesive side of the rectangular main body, the indicia including various terminology identifying different musical styles.

7. In combination, self adhesive labels and self adhesive flags, each of the self adhesive labels comprising a sheet of thin semi-rigid flexible material, each of said labels having an adhesive applied to a back portion thereof, each of said labels having three panels, said panels being long enough to embrace a front portion, side portion and back portion of a storage case for a video/audio tape or video/compact disc, each of the self adhesive flags comprising a sheet of thin semi-rigid flexible material, each of said flags having a rectangular main body and having a protruding label portion, each of said flags having an adhesive applied to a back side of the rectangular main body thereof leaving the protruding label portion adhesive free, each of said flags being long enough to embrace a side portion of a storage case for a video/audio tape or video/compact disc whereby the self adhesive labels and self adhesive flags can be attached to a number of storage cases to index and organize said storage cases.

8. The combination of claim 7 wherein each of said sheets of thin semi-rigid flexible material comprise a one piece plastic laminate.

9. The combination of claim 7 wherein said labels are printed with an alphabetic character on each of the three panels.

10. The combination of claim 7 wherein the labels have a printed indicia on each of the three panels, the indicia including various terminology identifying different musical styles.

11. The combination of claim 7 wherein said flags have an alphabetic character printed on both sides of the protruding portion.

12. The combination of claim 7 wherein said flags have a printed indicia on the non-adhesive side of the rectangular main body, the indicia including various terminology identifying different musical styles.

13. A self adhesive label comprising a sheet of thin semi-rigid flexible material, said label having three panels, said label having an adhesive applied to a back portion of each of the three panels, said panels being long enough to embrace and be adhesively secured to a front portion, side portion and back portion of a storage case for a video/audio tape or video/compact disc, said label having an area for adding printed indicia on each of the three panels whereby when the self adhesive label is attached to a storage case, the label can be seen and identified on three sides of said storage case.

14. The self adhesive label of claim 13 wherein said sheet of thin semi-rigid flexible material comprises a one piece plastic laminate.

15. The self adhesive label of claim 13 wherein said area for adding printed indicia has an alphabetic character printed on each panel.

16. The self adhesive label of claim 13 wherein said label has a color coding thereon.

17. The self adhesive label of claim 14 wherein said area for printed indicia on each of the three panels has various terminology identifying different musical styles.

18. A self adhesive flag comprising a one piece sheet of thin semi-rigid flexible material, said flag having a rectangular main body and having a protruding label portion, said flag having an adhesive applied to a back side along the entire length of the rectangular main body thereof leaving the protruding label portion adhesive free, said protruding label portion having an area for adding printed indicia on both sides thereof, said rectangular main body being long enough to embrace at least half of the length of a side portion of a storage case for a video/audio tape or video/compact disc for stabilizing the rectangular main body when attached to a storage case against disengagement, and said rectangular main body being wide enough to provide an area for adding printed indicia on a front side thereof whereby when the self adhesive flag is attached to a storage case, the protruding label portion can be seen and identified from two sides of said storage case.

19. The self adhesive flag of claim 18 wherein said sheet of thin semi-rigid flexible material comprises a one piece plastic laminate.

20. The self adhesive flag of claim 18 wherein said protruding label portion includes an alphabetic character printed on each side.

21. The self adhesive flag of claim 18 wherein said rectangular main body of the flag has a printed indicia, the indicia including various terminology identifying different musical styles.

* * * * *